US006796512B2

(12) United States Patent
Grieb et al.

(10) Patent No.: US 6,796,512 B2
(45) Date of Patent: Sep. 28, 2004

(54) HIGH-PRESSURE-PROOF INJECTOR BODY

(75) Inventors: Martin Grieb, Oberstenfeld (DE); Stefan Haug, Waldenbuch (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/274,106

(22) Filed: Oct. 21, 2002

(65) Prior Publication Data

US 2003/0089793 A1 May 15, 2003

(30) Foreign Application Priority Data

Oct. 20, 2001 (DE) ..... 101 52 230

(51) Int. Cl.[7] ..... F02M 47/02; F02M 39/00; B05R 1/30

(52) U.S. Cl. ..... 239/88; 239/533.3; 239/533.12; 239/585.5

(58) Field of Search ..... 239/88, 89, 91, 239/93, 533.2, 533.3, 533.12, 585.1, 585.2, 585.3, 585.4, 585.5, 594, 595; 251/129.15, 129.21, 127

(56) References Cited

U.S. PATENT DOCUMENTS 4,709,679 A * 12/1987 Djordjevic et al. ..... 123/447
4,875,658 A * 10/1989 Asai ..... 251/129.21
5,755,190 A * 5/1998 Ronen ..... 123/41.72
5,881,957 A * 3/1999 Mizuno et al. ..... 239/533.2
6,367,444 B1 * 4/2002 Yonezawa et al. ..... 123/302
6,598,592 B2 * 7/2003 Scollard et al. ..... 123/470

FOREIGN PATENT DOCUMENTS

GB 0753659 A1 * 1/1997 ..... F02M/47/02

* cited by examiner

*Primary Examiner*—Davis Hwu
(74) *Attorney, Agent, or Firm*—Ronald E. Greigg

(57) ABSTRACT

The invention relates to an injector body for a fuel injection system, in which the injector body has a substantially cylindrically shaped valve chamber, into which fuel can be introduced at high pressure via an inlet bore, which discharges through an inlet opening in the valve chamber. To compensate for the high local notch tensile stresses in the circumferential direction of the valve chamber, it is proposed that at least in the region of the inlet opening, the valve chamber be provided with bulges, each adjacent the inlet opening in the circumferential direction. These bulges bring about a major compensation for the notch tensile stresses and thus increase the high-pressure strength.

16 Claims, 2 Drawing Sheets

HIGH-PRESSURE-PROOF INJECTOR BODY

BACKGROUND OF THE INVENTION

1. Field of the Invention

The invention relates to an injector body for a fuel injection system, in which the injector body has a substantially cylindrically shaped valve chamber, into which fuel can be introduced at high pressure via an inlet bore, which discharges into an inlet opening in the valve chamber.

2. Description of the Prior Art

Injector bodies for fuel injection systems of the above type have a cylindrically shaped valve chamber, in whose wall the inlet opening of an inlet bore is located. The inlet bore communicates in turn with a pressure connection, at which the inlet line for fuel that is at high pressure discharges from a common rail. The high-pressure strength of the injector body depends on the geometry of the inlet region. The intersection of the inlet bore with the valve chamber represents the point that is subjected to the most severe load. One of the parameters here is the inlet angle of the inlet bore from the common rail into the injector body. If this angle between the center axis of the inlet bore and the longitudinal axis of the valve chamber is approximately 90°, then the stresses in the region of intersection can be kept slight. However, installation conditions at the cylinder head of an internal combustion engine do not always allow inlet angles of 90°.

The primary stress on the point of intersection is caused by the internal pressure applied. Under this internal pressure, the notch effect of the inlet bore in the region of intersection of the bores leads to high local notch tensile stresses in the circumferential direction of the valve chamber. Even if the inlet angle is optimal, the aforementioned tensile stresses are the limiting factor for the high-pressure strength of the injector body.

OBJECT AND SUMMARY OF THE INVENTION

It is accordingly the object of the invention to reduce the notch tensile stresses in the circumferential direction of the valve chamber, in an injector body of the generic type in question, so that the injector body can be designed for higher pressure loads.

In the embodiment proposed according to the invention, the valve chamber, at least in the region of the inlet opening, has a bulge in its cross section in the circumferential direction adjacent to each inlet opening. Accordingly, there is an increase in volume in the valve chamber on both sides of the inlet opening. As a result, the valve chamber deforms, in the region of intersection of the bores, under internal pressure in such a way that because of the greater curvature in the region of the high-pressure intersection, bending pressure stresses and circumferential tensile stresses are superimposed on one another, which in turn reduces the notch tensile stresses in the region of intersection of the two bores (that is, the inlet bore and the valve chamber bore).

In this respect, bulges that are shaped symmetrically on both sides of the inlet opening are advantageous. Because of this symmetry, incident stresses can be compensated for optimally.

If the inlet angle (the angle between the center axis of the inlet bore and the longitudinal axis of the valve chamber) is 90°, then the bulges proposed according to the invention in the valve chamber cross section are advantageously located in a plane that is perpendicular to the longitudinal axis of the valve chamber. In the longitudinal direction of the valve chamber, the bulge extends at least across the region of the inlet opening. At inlet angles other than 90°, it may be advantageous for the plane in which the bulges are located to be oriented in the same way as the inlet bore, so that the center line of the inlet bore passes through this plane. Usually, however, it is sufficient, and simpler from a production standpoint, to place the bulges with a cross section perpendicular to the longitudinal axis of the valve chamber.

The valve chambers, which in most cases are shaped cylindrically, accordingly have a circular cross section (perpendicular to the longitudinal axis of the valve chamber). The bulges according to the invention each extend, in the region of the inlet opening of the inlet bore, in the circumferential direction of the valve chamber adjacent to the inlet opening, so that the bulges bring about a departure from the circular cross section. It has been found that a major increase in strength ensues if a bulge extends at least as far as a plane that passes through the inlet opening and extends parallel to the longitudinal axis of the valve chamber. It is again especially advantageous in this respect if the bulges are disposed symmetrically to the inlet opening. If the bulges extend past the aforementioned plane, then the bending pressure stresses that occur under internal pressure in the region of the inlet opening can compensate even better for the incident notch tensile stresses.

In an embodiment in which the bulges proposed according to the invention extend as far as the aforementioned plane, which extends parallel to the longitudinal axis of the valve chamber and through the inlet opening, it is advantageous if the valve chamber cross section is continued uniformly as far as that plane; the diameter can then be equivalent to the maximum diameter of the valve chamber. In such an embodiment, it has been found that a further increase in strength can be attained if the inlet bore extends eccentrically relative to the valve chamber.

BRIEF DESCRIPTION OF THE DRAWING

The invention will be better understood and further objects and advantages thereof will become more apparent from the ensuing detailed description of preferred embodiments taken in conjunction with the drawing, in which.

DESCRIPTION OF THE PREFERRED EMBODIMENTS

Figure 1:
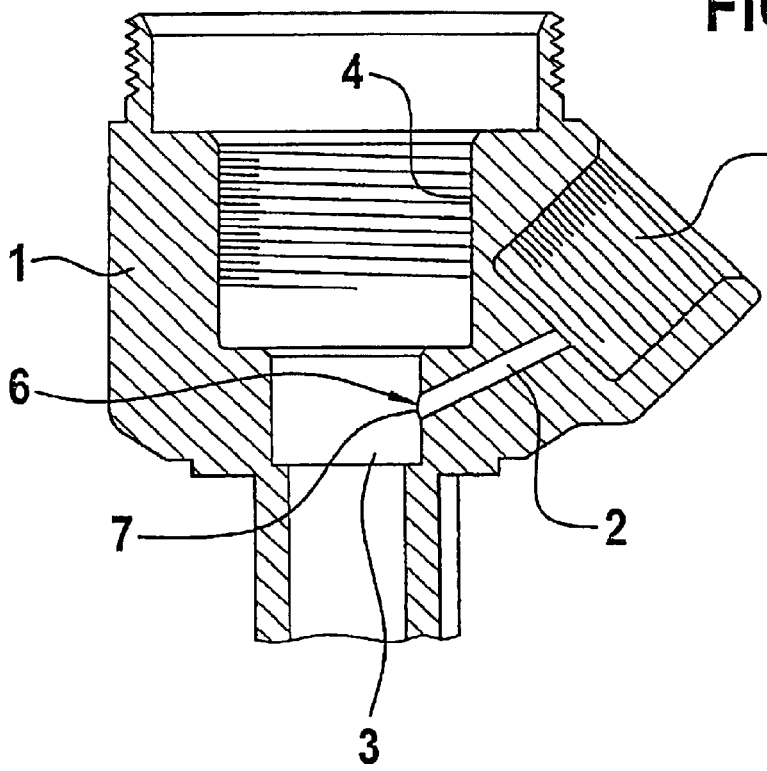
FIG. 1 is a section taken through the longitudinal axis of an injector body for a high-pressure fuel injection system.

The essential structure of an injector body 1 is shown in FIG. 1, in a section through the longitudinal axis of the injector body 1.

The injector body 1 includes a substantially cylindrical valve chamber 3, in whose wall an inlet opening 7 for supplying fuel that is at high pressure is located. This inlet opening 7 forms the orifice of the inlet bore 2 into the valve chamber 3. The inlet bore 2 leads to the pressure connection 5, to which the common rail is connected. The injector body for its part has a female thread 4 for connection to the injection system.

In the region 6 of intersection of the inlet bore 2 with the valve chamber 3, severe stresses occur because of the high fuel pressures. At high internal pressures, the notch effect of the inlet bore 2 in the intersection region 6 leads to high local notch tensile stresses in the circumferential direction of the valve chamber 3, creating the risk of fissuring. Fissures that develop lead in the final analysis to failure of the injector. The inlet angle, that is, the angle between the longitudinal axis of the valve chamber 3 and the center axis of the inlet bore, is indeed less than 90°, in the view of FIG. 1, but is still in the range above 75°, that is, a range within which a stress-reducing action is provided by the inlet angle.

Figure 2A:
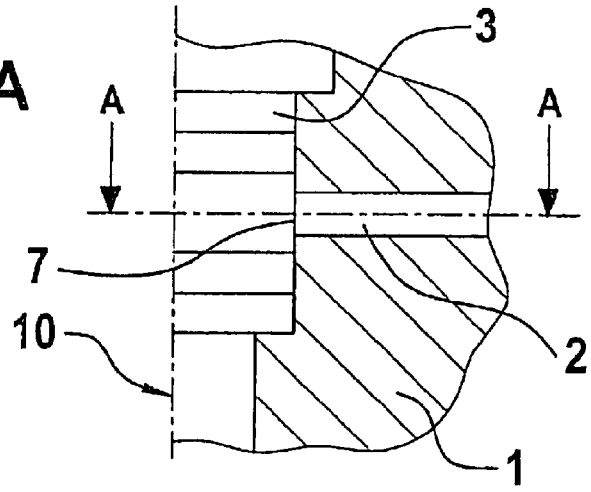
FIG. 2A is an enlarged, fragmentary, highly schematic longitudinal section through an injector body of the invention.

In FIG. 2A, an injector body 1 of the invention is shown, highly schematically, in the same view as in FIG. 1. Identical elements are identified by the same reference numerals. Here, the inlet bore 2 leads at a right angle to the valve chamber 3 of the injector body 1. In the view of FIG. 2A, the bulges 8, located in the plane perpendicular to the plane of the drawing, in the valve chamber cross section are hardly apparent, because of the view chosen. Conversely, the section shown in FIG. 2B, which is taken along the line A—A in FIG. 2A, clearly shows the bulges 8 according to the invention on both sides of the inlet opening 7 of the inlet bore 2. In this example, the bulges 8 in the valve chamber cross section are embodied symmetrically to the inlet opening 7 and are extended far to the rear in the direction of the inlet bore. As can be seen from FIG. 2B, the bulges 8 change the cross section of the valve chamber 3, at least in the region of the inlet opening 7, to such an extent that the originally circular cross section is now maintained only in the half of the valve chamber 3 located opposite the inlet opening 7, while in the other half, the valve chamber continues with its maximum diameter as far as a plane 9, which extends parallel to the longitudinal axis 10 of the valve chamber 3 and through the inlet opening 7, and beyond that plane, the valve chamber has two indentations that are located symmetrically to the center line of the inlet bore 2 and are behind the plane 9.

The bulges 8 shown cause a deformation of the valve chamber 3 under internal pressure, leading to the development of bending pressure stresses and circumferential tensile stresses in the region of the bulges 8, which reduce the notch tensile stresses in the intersection region 6. Overall, a partial compensation for the incident stresses thus occurs, so that the maximum tensile stress in the intersection region 6 is reduced.

Figure 2B:
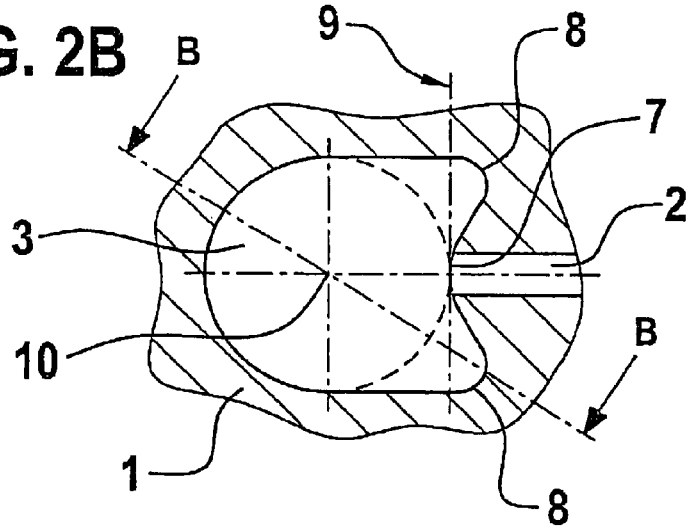
FIG. 2B is a section taken through the line A—A of FIG. 2A.
Figure 2C:
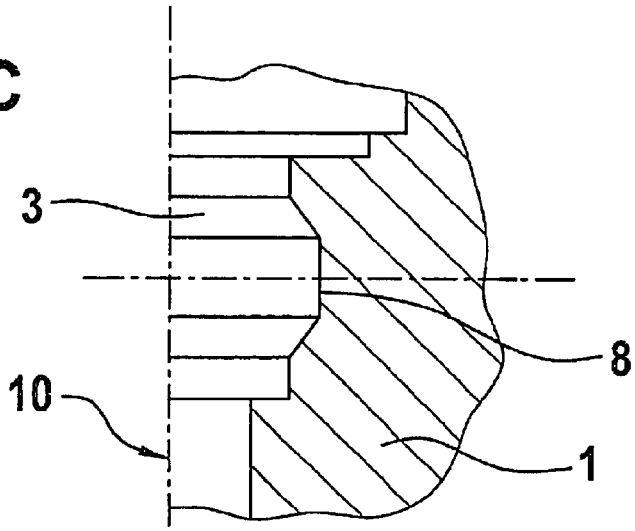
FIG. 2C is a section taken through the line B—B of FIG. 2B.

FIG. 2C shows a section taken along the B—B of FIG. 2B. This shows the course of the bulges 8 in the longitudinal direction of the valve chamber 3. The bulges 8 are concentrated in the region of the inlet opening 7, and they decrease again to both sides in the longitudinal direction of the valve chamber 3, so that the valve chamber 3 there resumes its original cylindrical shape.

Figure 3:
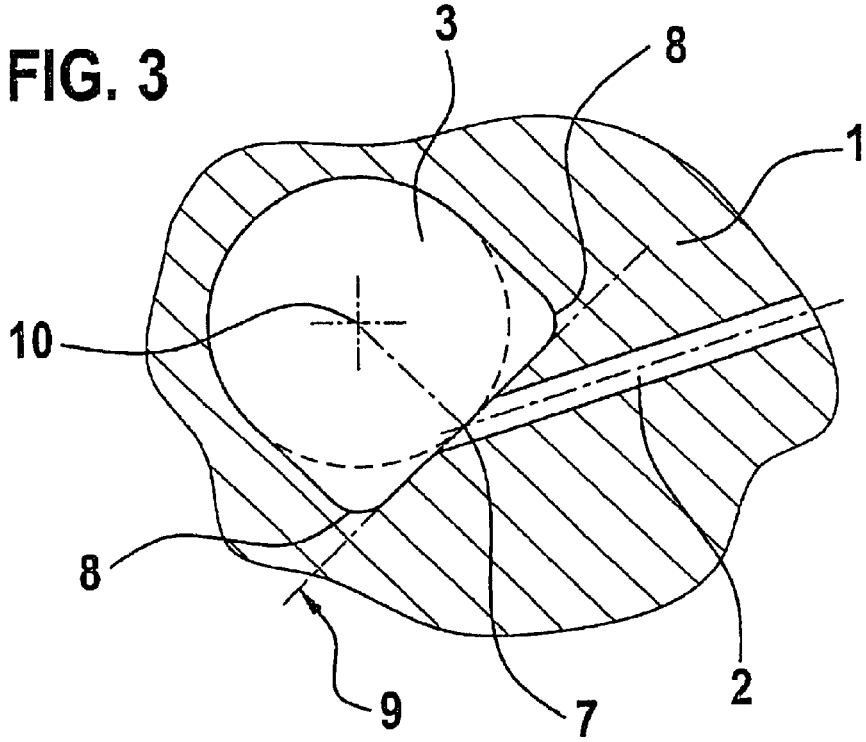
FIG. 3, is a view similar to FIG. 2B showing a further embodiment of the injector body of the invention.

Another embodiment of the invention is shown schematically in FIG. 3. Here as well, the valve chamber 3 bulges 8 to both sides of the inlet opening 7, so that the overall result is a symmetrical cross section of the valve interior 3; here, there is a widening of the originally circular cross section to a cross section of constant diameter, which is equivalent to that of the circular valve chamber 3, as far as the plane 9 that extends parallel to the longitudinal axis 10 of the valve chamber 3 and through the inlet opening 7. The eccentric disposition of the inlet bore 2 in this exemplary embodiment has proved to be a further strength-increasing provision.

In summary, by means of the invention, various geometries of valve chamber cross sections in the region of the inlet opening can be employed, which lead to a reduction in the incident stresses in the intersection region and thus to an increase in the high-pressure strength of the injector body. Particularly in the case of high-pressure fuel injectors, good successes can thus be attained.

The foregoing relates to preferred exemplary embodiments of the invention, it being understood that other variants and embodiments thereof are possible within the spirit and scope of the invention, the latter being defined by the appended claims.

We claim:

1. An injector body for a fuel injection system, in which the injector body (1) has a longitudinal axis and a substantially cylindrically shaped valve chamber (3), into which fuel can be introduced at high pressure via an inlet bore (2), which discharges into an inlet opening (7) in the valve, chamber (3), the inlet bore having a center axis located at an angle to the longitudinal axis of the injector body, the improvement wherein the valve chamber (3), at least in the region of the inlet opening (7), has a bulge (8) in its cross section in the circumferential direction adjacent to each side of the inlet opening (7), such that the radius of the valve chamber cross section in a plane perpendicular to the longitudinal axis of the injector body and passing through the center axis of the inlet bore at the inlet opening varies in the circumferential direction.

2. The injector body according to claim 1 wherein the bulges (8) are located symmetrically to the center line of the inlet bore (2).

3. The injector body according to claim 2 wherein the bulge (8) extends up to or beyond a plane (9) that extends parallel to the longitudinal axis (10) of the valve chamber (3) and through the inlet opening (7).

4. The injector body according to claim 3 wherein, in the longitudinal direction of the valve chamber (3) over the region of the inlet opening (7), the bulges (8) lead to a constant cross-sectional enlargement of the valve chamber (3).

5. The injector body according to claim 2 wherein, in the longitudinal direction of the valve chamber (3) over the region of the inlet opening (7), the bulges (8) lead to a constant cross-sectional enlargement of the valve chamber (3).

6. The injector body according to claim 1 wherein the bulge (8) extends up to or beyond a plane (9) that extends parallel to the longitudinal axis (10) of the valve chamber (3) and through the inlet opening (7).

7. The injector body according to claim 6 wherein, in the longitudinal direction of the valve chamber (3) over the region of the inlet opening (7), the bulges (8) lead to a constant cross-sectional enlargement of the valve chamber (3).

8. The injector body according to claim 1 wherein, in the longitudinal direction of the valve chamber (3) over the region of the inlet opening (7), the bulges (8) lead to a constant cross-sectional enlargement of the valve chamber (3).

9. An injector body for a fuel injection system, in which the injector body (1) has a substantially cylindrically shaped valve chamber (3), into which fuel can be introduced at high pressure via an inlet bore (2), which discharges into an inlet opening (7) in the valve chamber (3), the improvement wherein the valve chamber (3), at least in the region of the inlet opening (7), has a bulge (8) in its cross section in the circumferential direction adjacent to each side of the inlet opening (7), wherein the bulge (8) extends up to or beyond a plane (9) that extends parallel to the longitudinal axis (10) of the valve chamber (3) and through the inlet opening (7) and wherein the bulges (8) extend symmetrically and uniformly as far as the plane (9), so that the width of the valve chamber cross section in the region of the bulges (8) is equivalent to the inside diameter of the cylindrical valve chamber (3).

10. The injector body according to claim 9 wherein the inlet bore (2) is disposed eccentrically to the valve chamber (3).

11. The injector body according to claim 10 wherein, in the longitudinal direction of the valve chamber (3) over the region of the inlet opening (7), the bulges (8) lead to a constant cross-sectional enlargement of the valve chamber (3).

12. The injector body according to claim 9 wherein, in the longitudinal direction of the valve chamber (3) over the region of the inlet opening (7), the bulges (8) lead to a constant cross-sectional enlargement of the valve chamber (3).

13. An injector body for a fuel injection system, in which the injector body (1) has a substantially cylindrically shaped valve chamber (3), into which fuel can be introduced at high pressure via an inlet bore (2), which discharges into an inlet opening (7) in the valve chamber (3), the improvement wherein the valve chamber (3), at least in the region of the inlet opening (7), has a bulge (8) in its cross section in the circumferential direction adjacent to each side of the inlet opening (7), wherein the bulges (8) are located symmetrically to the center line of the inlet bore (2), wherein the bulge (8) extends up to or beyond a plane (9) that extends parallel to the longitudinal axis (10) of the valve chamber (3) and through the inlet opening (7), and wherein the bulges (8) extend symmetrically and uniformly as far as the plane (9), so that the width of the valve chamber cross section in the region of the bulges (8) is equivalent to the inside diameter of the cylindrical valve chamber (3).

14. The injector body according to claim 13 wherein the inlet bore (2) is disposed eccentrically to the valve chamber (3).

15. The injector body according to claim 14 wherein, in the longitudinal direction of the valve chamber (3) over the region of the inlet opening (7), the bulges (8) lead to a constant cross-sectional enlargement of the valve chamber (3).

16. The injector body according to claim 13 wherein, in the longitudinal direction of the valve chamber (3) over the region of the inlet opening (7), the bulges (8) lead to a constant cross-sectional enlargement of the valve chamber (3).

* * * * *